United States Patent [19]

Stahnke

[11] Patent Number: 4,593,592

[45] Date of Patent: Jun. 10, 1986

[54] METHOD AND APPARATUS FOR ALTERING ACTUATOR DRIVE IN A REPRODUCING PIANO

[75] Inventor: Wayne L. Stahnke, Marina del Rey, Calif.

[73] Assignee: Kimball International, Inc., Jasper, Ind.

[21] Appl. No.: 747,772

[22] Filed: Jun. 24, 1985

[51] Int. Cl.[4] ..... G10F 1/02; G10H 3/00

[52] U.S. Cl. ..... 84/21; 84/1.1; 84/DIG. 29

[58] Field of Search ..... 84/19–23, 84/115, 1.1, 1.28, DIG. 29, 462

[56] References Cited

U.S. PATENT DOCUMENTS

| | | | |
|---|---|---|---|
| 3,604,299 | 9/1971 | Englund | 84/1.03 |
| 3,789,719 | 2/1974 | Maillet | 84/115 |
| 3,895,554 | 7/1975 | Maillet | 84/115 |
| 3,905,267 | 9/1975 | Vincent | 84/115 |
| 4,023,456 | 5/1977 | Groeschel | 84/115 |
| 4,080,863 | 3/1978 | Groeschel | 84/1.27 |
| 4,104,950 | 8/1978 | Finley | 84/462 |
| 4,132,141 | 1/1979 | Campbell et al. | 84/115 |
| 4,132,142 | 1/1979 | Campbell et al. | 84/115 |
| 4,135,428 | 1/1979 | Campbell | 84/1.24 |
| 4,169,401 | 10/1979 | Walker | 84/22 |
| 4,172,403 | 10/1979 | Campbell et al. | 84/1.28 |
| 4,174,652 | 11/1979 | Campbell | 84/1.28 |
| 4,176,578 | 12/1979 | Campbell et al. | 84/115 |
| 4,215,619 | 8/1980 | Budelman et al. | 84/1.28 |
| 4,307,648 | 12/1981 | Stahnke | 84/462 |
| 4,351,221 | 9/1982 | Starnes et al. | 84/1.28 |
| 4,450,749 | 5/1984 | Stahnke | 84/462 |
| 4,469,000 | 9/1984 | Fujiwara et al. | 84/115 |

*Primary Examiner*—L. T. Hix
*Assistant Examiner*—Douglas S. Lee
*Attorney, Agent, or Firm*—Jeffers, Irish & Hoffman

[57] ABSTRACT

A method and apparatus for altering the solenoid drive during playback in a reproducing piano to prevent double hammer strikes. The key is depressed by a solenoid under constant velocity until the point of let-off, and the velocity is then increased to accelerate the continued movement of the key and action so that the hammer rebounding from the string will fall without rebounding from the action against the string a second time. In a preferred embodiment, a microprocessor evaluates the key velocity drive value, and if the velocity called for is above a predetermined level, then no boost is applied to the solenoid.

16 Claims, 9 Drawing Figures

METHOD AND APPARATUS FOR ALTERING ACTUATOR DRIVE IN A REPRODUCING PIANO

BACKGROUND OF THE INVENTION

The present invention relates to a reproducing piano, and in particular to an improved method and apparatus for altering the actuator drive during playback to prevent double hammer strikes against the strings.

It is known to record performances of a piano on magnetic tape, for example, and reproduce the performance by replaying the tape and causing the keys to be actuated mechanically. During the record mode, the piano is played by a musician, and sensors detect the timing and velocity with which the keys are depressed or the hammers are moved, and this information is stored digitally in a permanent memory, such as a magnetic tape. During playback, the digital information is retrieved from the tape and converted to analog control signals that energize actuators to play the keys in the same pattern and with the same dynamics as during the original performance.

In U.S. Pat. No. 4,307,648, which patent is incorporated herein by reference, there is disclosed a method and apparatus for measuring the dynamics of a piano performance wherein a shutter is provided for each hammer shank of the piano, as well as a separate optical switch assembly and counter that is responsive to the trigger signals produced as the shutter eclipses the light beam. The counter is responsive to an initiating signal from the optical switch assembly to start the counter and to an end of count signal from the optical switch to terminate the count, the total count defining a time increment. The total count registered comprises a digital signal constituting an inverse function of the near terminal hammer velocity, that is, the velocity of the hammer just before it strikes the string. Digital information corresponding to the count is stored on magnetic tape for recall during playback and reproduction of the original performance.

A microprocessor retrieves the data from the magnetic tape and produces a digital drive value corresponding to the particular key velocity required. A digital-to-analog converter converts the digital drive value to an analog voltage that is proportional to the desired key velocity. A feedback servomechanism circuit comprising a plurality of operational amplifiers and a sense coil is connected to a solenoid and energizes the solenoid with a current that produces a constant velocity. The velocity is maintained constant by means of the auxiliary sense coil within which a permanent magnet connected to the solenoid moves; the coil is connected to the input of the first operational amplifier. This circuit arrangement causes the solenoid to operate as a linear motor with constant velocity, thereby ensuring that transit times and key velocity can be maintained within very close tolerances so that the playback performance is an accurate reproduction of the original performance.

Although the linear key velocity technique on playback is extremely beneficial to accurate reproduction, it generates an unforeseen problem. The action in a piano engages the hammer as the key is depressed until the point of escapement, or "let-off", at which point the action falls away from the hammer and the hammer continues to travel toward the string in free flight. When a human pianist plays a piano, the key is typically accelerated throughout its travel so that at the point of let-off, the key moves with increasing velocity, and this increase is further enhanced because of the reduction in effective mass due to the free flight of the hammer. Thus, the escapement mechanism is very quickly accelerated out of the way of the hammer so that as the hammer rebounds from the string, it does not hit the jack, which is the particular element that throws the hammer toward the string. Thus, the hammer is able to drop back and will not rebound against the string to cause a double strike, as would occur if the jack were still positioned beneath the repetition roller attached to the hammer.

In a reproducing piano of the type discussed previously, the constant velocity solenoid drive causes the key to be depressed with a constant velocity throughout its travel both before and after let-off occurs. When loud note strikes are played back, there is normally no problem because there is sufficient key velocity to move the jack out of the way of the rebounding hammer to prevent double strikes. However, when quieter passages are played and the key is depressed with lower velocity, there is not sufficient velocity after let-off, because of the constant velocity actuation of the key, to cause the jack to be moved out of the way of the rebounding hammer, and the hammer will rebound off the jack and strike the string a second time thereby producing an objectionable echoing effect.

The double strike effect is not a problem in certain prior art reproducing pianos wherein the solenoid is energized with a constant current or constant voltage, because the force produced by the solenoid increases with stroke, thereby causing an acceleration of the key and action after the point of let-off. However, the constant current or constant voltage solenoid that results in a variable velocity drive, cannot accurately reproduce the original performance as can the constant velocity drive system described earlier.

Accordingly, it is desirable to provide a drive system for a reproducing piano having the advantages of a constant velocity drive, yet being able to avoid the double strike effect which is an inherent phenomenon of a constant velocity drive.

SUMMARY OF THE INVENTION

The disadvantage of a constant velocity drive for a reproducing piano as discussed above is overcome by the present invention, in one form thereof, by sensing the point of let-off and then boosting the solenoid drive so that the solenoid is actuated with a higher velocity, thereby accelerating the action out of the way of the rebounding hammer and avoiding double strikes. In a preferred embodiment, when actuation of a key is called for by the microprocessor in response to data retrieved from the magnetic tape, a first velocity drive value is installed, causing the key to be depressed with a constant velocity up to the point of let-off. The point of let-off is sensed optically by a shutter connected to the hammer and a photocell system which transmits a signal triggering the system to boost the solenoid drive. The microprocessor then installs a second drive value calling for a higher velocity than the first velocity, thereby accelerating the action and moving the jack out of the way of the rebounding hammer so that the hammer can drop down onto the repetition lever and be engaged by the back check, which prevents further rebounding.

In a preferred embodiment of the invention, the velocity drive value called for each key is determined, and if the velocity is higher than a predetermined level, then the solenoid boost is not employed. This is because if the key is actuated with a sufficiently high velocity, then the action will move out of the way of the rebounding hammer without the necessity for additional boost. If the velocity called for is below the predetermined level, however, then boost is employed to prevent the double strike effect.

The reproducing piano in accordance with one form of the invention comprises a plurality of keys and a piano action actuated by the keys to move hammers into contact with respective strings when the pertaining keys are depressed, the hammers being positively engaged by the action until let-off occurs, after which the hammers travel in free flight toward the strings. A key actuation circuit, including solenoids in engagement with the keys, selectively move the keys at a substantially constant velocity until let-off occurs, and then move the keys at a second higher velocity whereby the action is accelerated after let-off to prevent double hammer strikes.

In accordance with another form of the invention, the reproducing piano comprises a plurality of keys, a piano action and a solenoid in engagement with each of the keys for actuating the respective key when the solenoid is energized. A control circuit including a closed loop current supply circuit is connected to each solenoid to energize the solenoid at a first substantially constant velocity during a first portion of the hammer actuating travel of the pertaining key, and then energize the solenoid at a second velocity larger than the first velocity during a second portion of the hammer actuating travel of the key.

A method according to one aspect of the invention comprises passing a current through the solenoid to depress the key at a first substantially constant velocity thereby causing the action to move the hammer with continuous positive engagement until the point of let-off, at which time the hammer begins to travel in free flight toward the string. Subsequently, a current is passed through the solenoid to depress the key at a second velocity higher than the first velocity beginning at about the point of let-off to accelerate a portion of the action out of the return path of the hammer as the hammer rebounds from the string thereby preventing double strikes of the hammer against the string caused by rebound against the action.

In accordance with yet another aspect of the invention, the method comprises retrieving a first solenoid drive value from a non-volatile memory, energizing the solenoid under the control of the first drive value to cause the key to be depressed with a first velocity, and determining whether the first drive value is greater than a predetermined level. Let-off is detected and a second solenoid drive value is installed corresponding to a second velocity only if the first drive value is greater than the predetermined level, and the solenoid is energized under the control of the second drive value to cause the key to be depressed with a second velocity higher than the first velocity following let-off if the second drive value is installed.

It is an object of the present invention to provide a technique and apparatus for altering solenoid drive in a reproducing piano whereby the beneficial effects of constant solenoid velocity are realized, yet double strikes are prevented.

DETAILED DESCRIPTION

Figure 1:
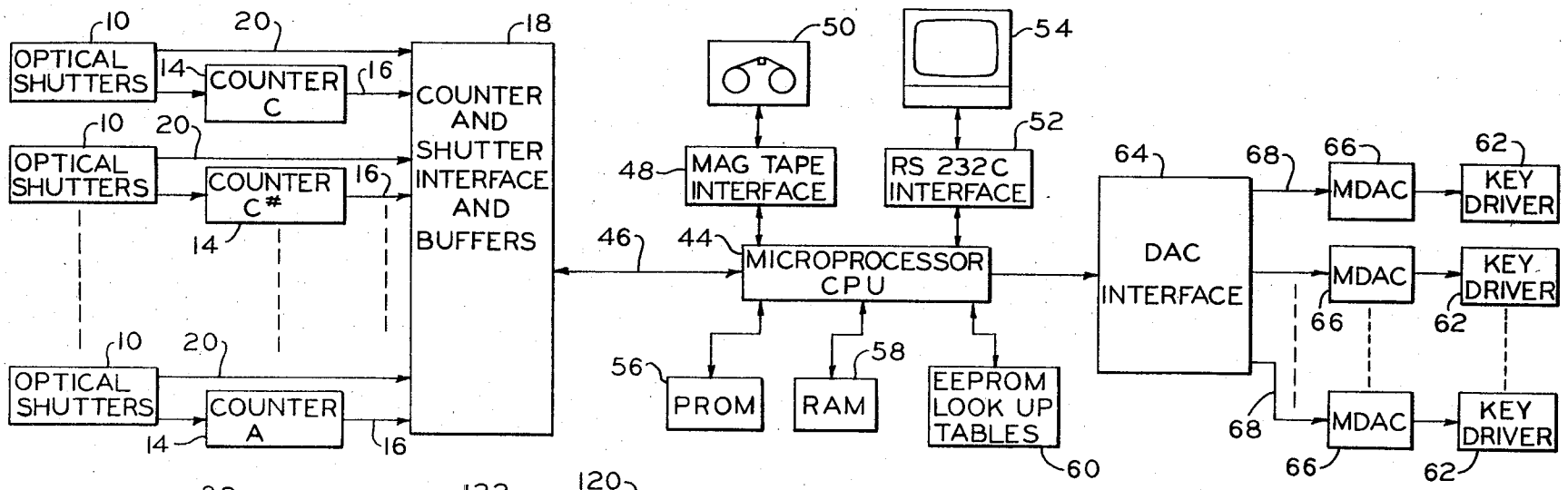
FIG. 1 is a block diagram of a reproducing piano control system employing the method and apparatus of the present invention.

Referring now to FIG. 1, a plurality of optical shutter devices 10 for each of the hammer shanks 12 (FIG. 6) of the piano are shown having outputs connected to counters 14, which in turn have outputs 16 connected to a counter and shutter interface and buffer circuit 18. The optical shutter devices 10 and counters 14 are essentially the same devices as disclosed in the aforementioned U.S. Pat. No. 4,307,648. Optical shutter devices 10 also have inputs 20 to interface 18 to provide the triggering signal indicating let-off, as will be described in greater detail hereinafter.

Figure 5:
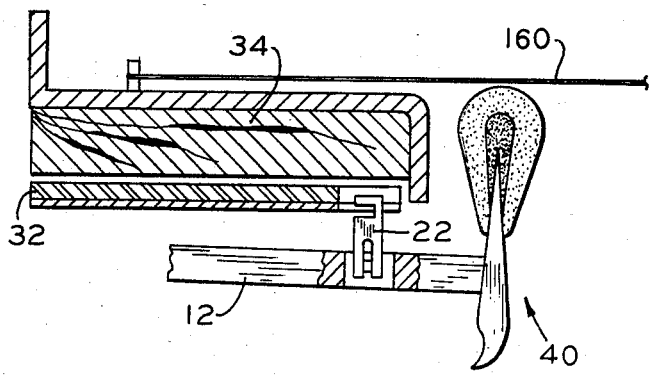
FIG. 5 is a side elevational view of a hammer and shutter.
Figure 6:
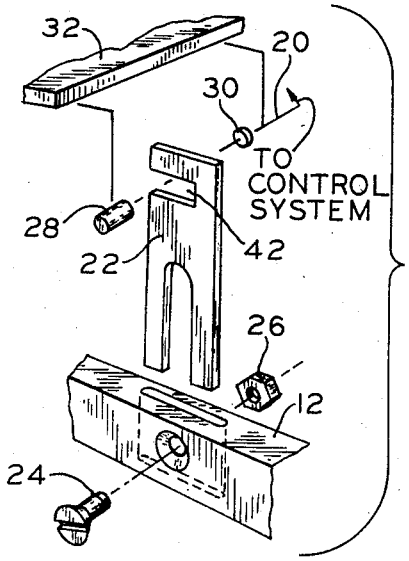
FIG. 6 is an enlarged perspective view of the shutter device connected to one of the hammers.

With reference to FIGS. 5 and 6, each of the shutter devices 10 includes a shutter 22 connected to the pertaining key and held in place by a bolt 24 and nut 26 so that the vertical position of the shutter can be adjusted. A light source 28 and photocell 30, the latter having an output 20 connected to interface 18 (FIG. 1), are mounted on a printed circuit board 32, which is located beneath the pin block 34.

As a key 36 (FIGS. 3 and 4) is depressed, the action 38 moves hammer 40 upwardly thereby causing shutter 22 to break the light beam between source 28 and photocell 30, and subsequently reestablish the light beam through slot 42.

Returning now to FIG. 1, counter and shutter interface 18 connects to microprocessor CPU 44 over bus 46. Also connected to microprocessor 44 are a magnetic tape interface 48 for transmitting data to and from tape drive 50 and an interface 52 for a CRT display 54. Programmable read only member 56 contains the program for microprocessor 44, RAM 58 functions as the scratchpad memory, and various data relating to solenoid drive, transit delay, calibration offset values and the like are stored in electronically erasable programmable read only memory 60.

Microprocessor 44 communicates to the key drivers 62 through a digital to analog converter interface 64 and to a plurality of respective multiplying digital-to-analog converters 66. MDAC's 66 convert the digital values on inputs 68 to analog values to control key drivers 62.

Figure 2:
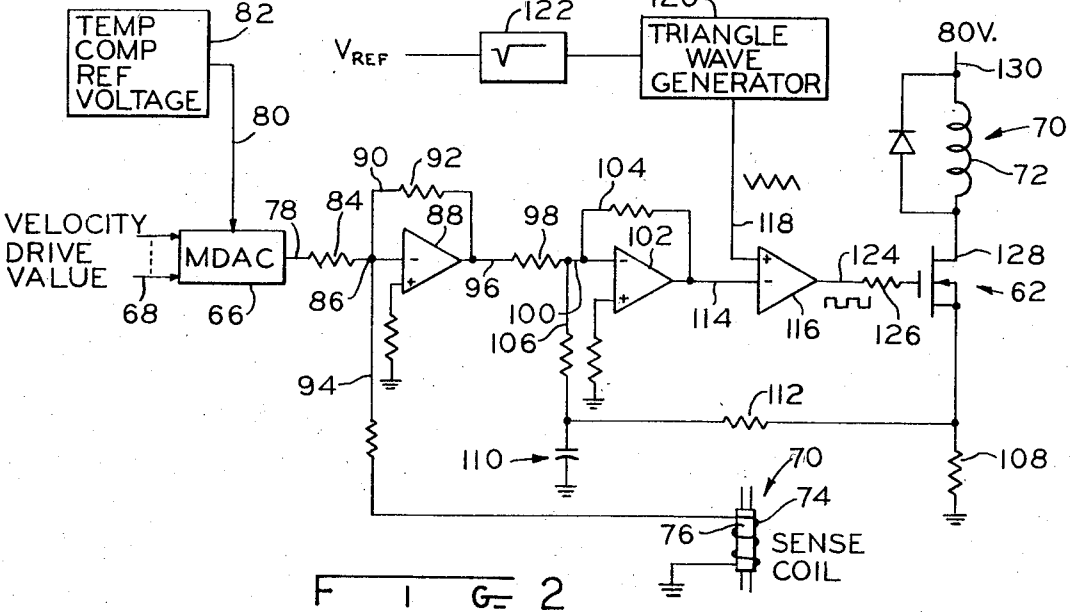
FIG. 2 is a circuit schematic of the local current feedback drive circuit for a solenoid.

FIG. 2 illustrates one of the key driver circuits 62, which includes solenoid 70 (FIG. 2) including a drive coil 72 and a sense coil 74, the latter being disposed around a permanent magnet 76. The digital velocity drive value on input lines 68 to multiplying DAC 66 is converted to an analog value on output 78 wherein a reference voltage on line 80 from temperature compensated reference voltage source 82 adjusts the full-scale analog output on line 78 depending on ambient temperature conditions. This enables the system to self-adjust for changes in ambient temperature to ensure that the solenoids 70 are actuated with the same velocity regardless of temperature.

The output of MDAC 66 is connected through input resistor 84 to a summing node 86 connected to the inverting input of operational amplifier 88. The other input is a feedback branch 90 including resistor 92 and the sense voltage input on line 94, which is produced by sense coil 74 as permanent magnet 76 moves linearly within coil 74. The output 96 of operational amplifier 88 is connected through resistor 98 to a summing node 100 connected to the inverting input 102, to which is connected also the feedback branch 104 and feedback branch 106, the latter being connected to a small current-sensing resistor 108 through an RC filter consisting of capacitor 110 and resistor 112. The output of op amp 102 on line 114 is proportional to the square root of the current that is desired through solenoid coil 72. This analog voltage is connected to one input of comparator 116 and the other input 118 is connected to a triangle wave generator 120, which is fed by a reference voltage through square root circuit 122. Op amp 116 produces on output 124 a pulse width modulated signal wherein the average voltage is proportional to the input on line 114. Op amp 116 is connected through resistor 126 to power MOSFET 128, which chops the high voltage on input 130 to solenoid coil 72 in accordance with the duty cycle of the pulse width modulated signal.

The voltage across resistor 108 is proportional to the square of the current through solenoid coil 70, and this voltage is fed back through resistor 112 and capacitor 110 to the inverting input of op amp 102. This arrangement causes the force in the solenoid, which is a function of the square of the current, to be proportional to the input voltage at point 96. The feedback loop comprising sense coil 74 causes the current through solenoid 70 to be adjusted as necessary to ensure a constant velocity as dictated by the voltage at the output of multiplying DAC 66 regardless of frictional forces in the piano action, changes in the solenoid values, etc., which can occur over time.

The net result of the circuit of FIG. 2 is that the velocity drive value set by microprocessor 44 is converted to a voltage which calls for a specific solenoid velocity, and circuit 62 converts this voltage to the necessary current to ensure the constant velocity depending on the drive value at input 68 to multiplying DAC 66. The velocity will remain constant throughout the travel of solenoid 70 until the drive value on input 68 is changed, or until the solenoid 70 reaches the end of its travel.

Figure 3:
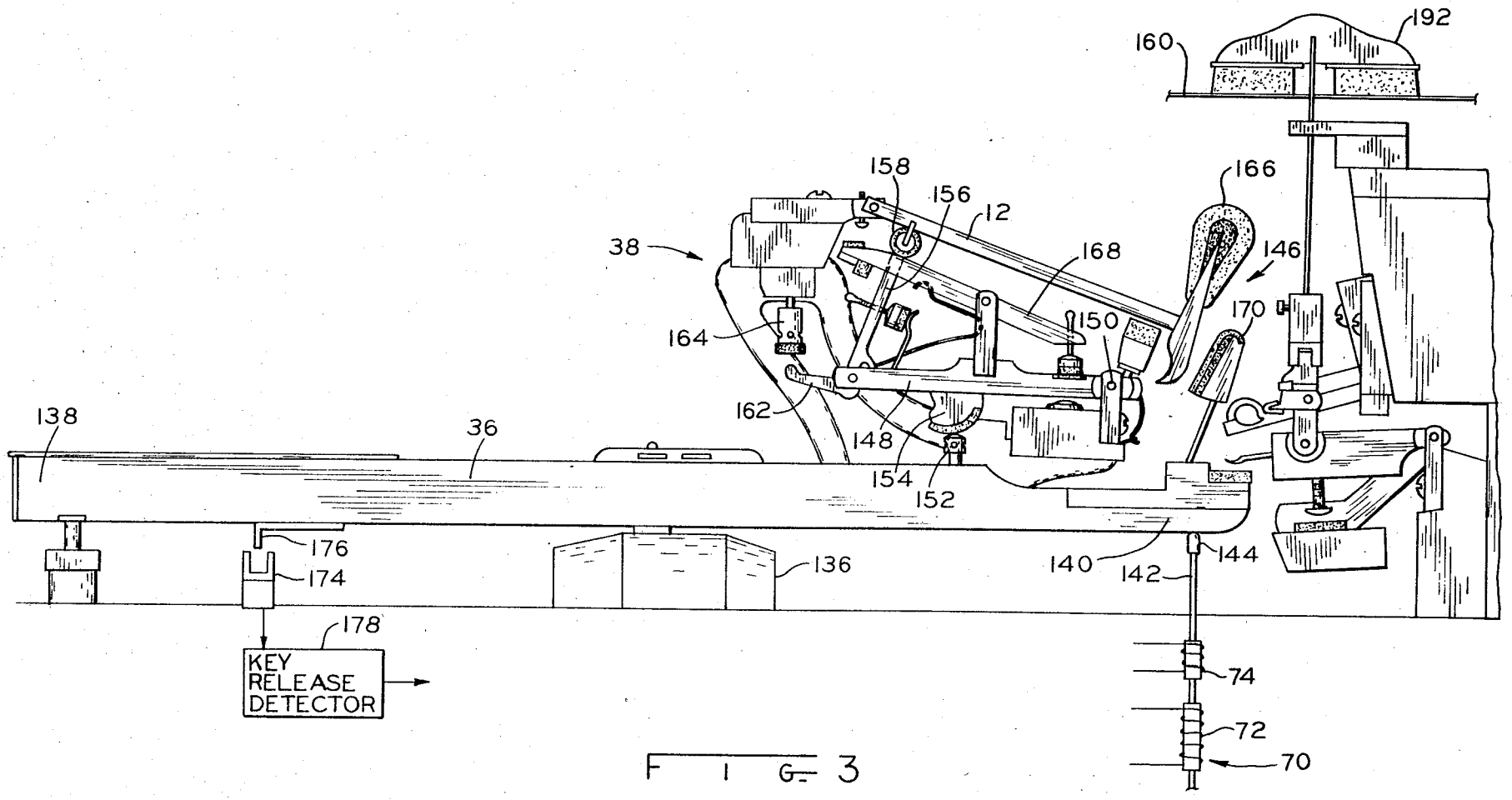
FIG. 3 is a side elevational view of a piano key, action and drive solenoid wherein the key is undepressed.
Figure 4:
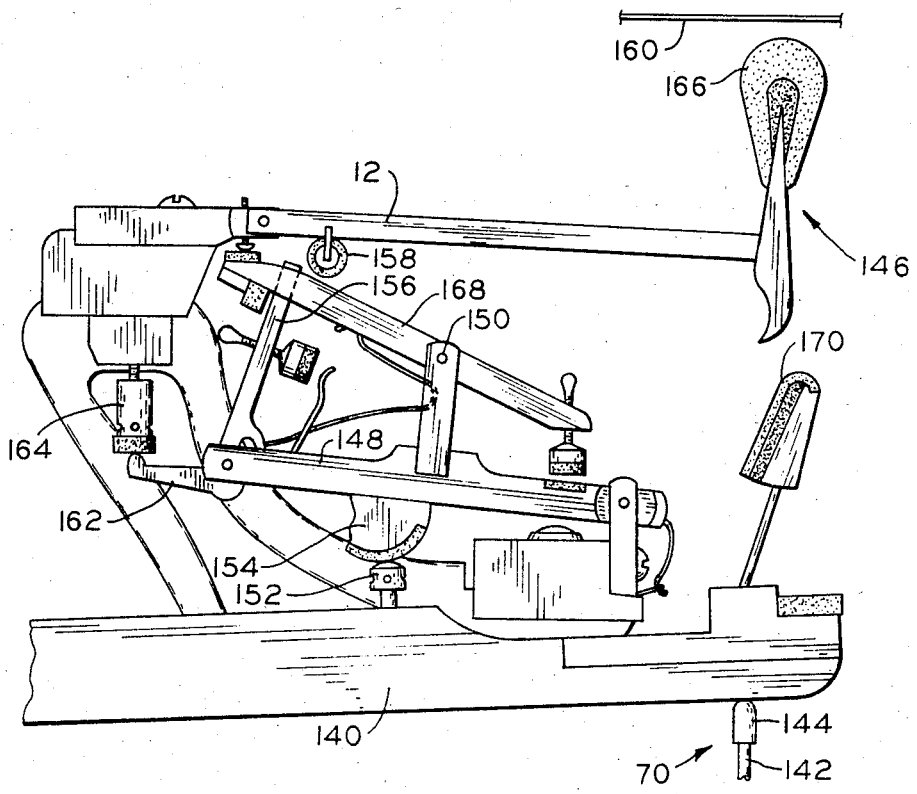
FIG. 4 is a fragmentary side elevational view of a piano key and action just after the point of let-off.

Turning now to FIGS. 3 and 4, the action for one of the keys 36 is illustrated in detail. Key 36 is pivoted on balance rail 136 so that when the end 138 is depressed, end 140 will be raised. Solenoid 70 comprises a pusher rod 142 and tip 144 which pushes the tail 140 of key 36 upwardly when solenoid 70 is actuated by current flowing through coil 72. Piano action 38 comprises a hammer 146 including shank 12 and a whippen 148 which pivots about point 150 when pushed upwardly by capstan 152 connected to key 36 and acting against whippen block 154. When this occurs, jack 156 pushes against repetition roller 158 connected to hammer shank 12 and moves hammer 146 under positive engagement toward string 160. During playback, key tail 140 is raised with constant velocity by solenoid 70.

FIG. 4 illustrates what occurs at the point of let-off. Jack 156 continues to push repetition roller 158 upwardly until arm 162 engages let-off button 164, at which time jack 156 is rotated counter-clockwise from under repetition roller 158. Thus, as head 166 of hammer 146 rebounds from string 160, repetition roller 158 will not contact jack 156, and hammer 146 will fall naturally against repetition lever, 168 and will be caught by back check 170. If jack 156 were still positioned beneath repetition roller 158 as hammer 146 rebounds from string 160, it would rebound back upwardly against string 160, thereby causing double strikes. If the velocity with which key 36 is depressed is sufficiently high, jack 156 will be moved out of the return path of repetition roller 158, but if key 36 is actuated by solenoid 70 with low velocity, and its velocity is constant due to the feedback circuit described earlier, jack 156 will not move out of the path of roller 158 quickly enough to prevent rebounding of hammer 146.

Also shown in FIG. 3 is an optical sensor 174 actuated by shutter 176 when the key is fully depressed, and having an output connected to a key release detector 178.

Figure 7:
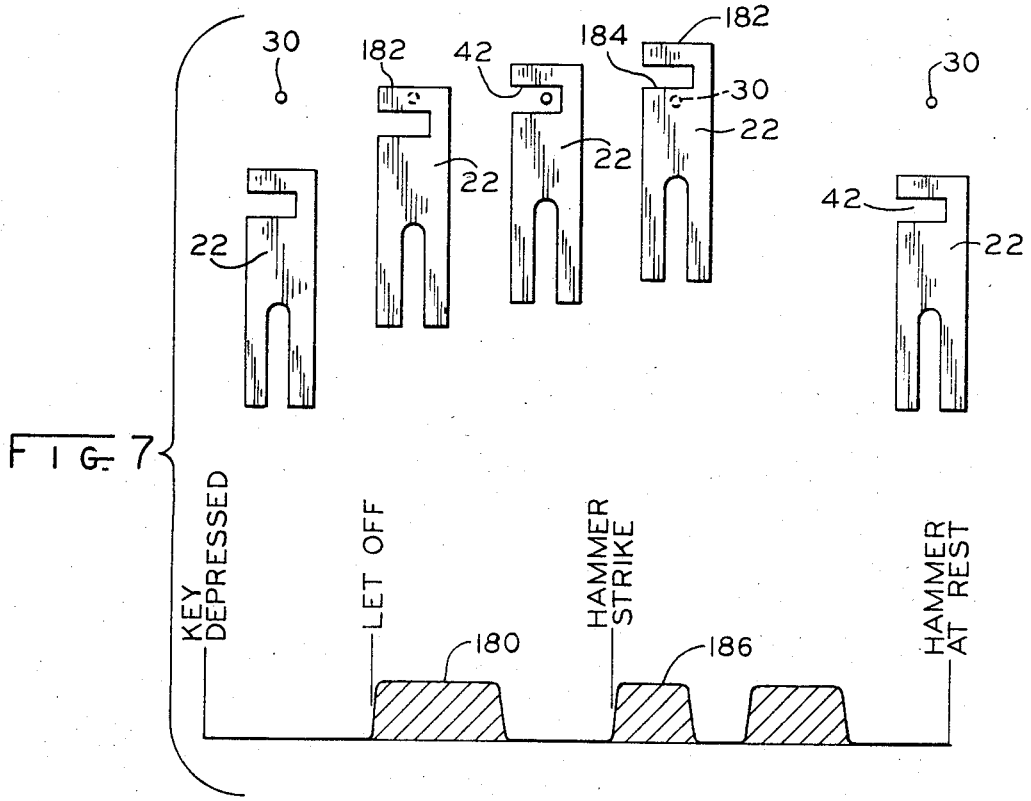
FIG. 7 is a diagrammatic view showing the movement of the shutter across the light path and the signals produced thereby.

FIG. 7 illustrates the manner in which let-off is detected by the system during playback. As the key 36 is depressed, action 38 raises hammer shank 12 toward string 160. Shutter 22 breaks the light beam between source 22 and photocell 30, thereby producing an output signal 180 on output line 20, which is connected to microprocessor 44 through interface 18. It is the upper edge 182 of shutter 22 that breaks the light beam, and this is the same shutter 22 as used for recording hammer velocity during the record mode as discussed in greater detail in U.S. Pat. No. 4,307,648. As shutter 22 continues further, the light beam is again opened by slot 42 and then broken again by the lower edge 184 of shutter 22, thereby producing signal 186 indicating that the hammer is about to strike string 160.

Figure 8:
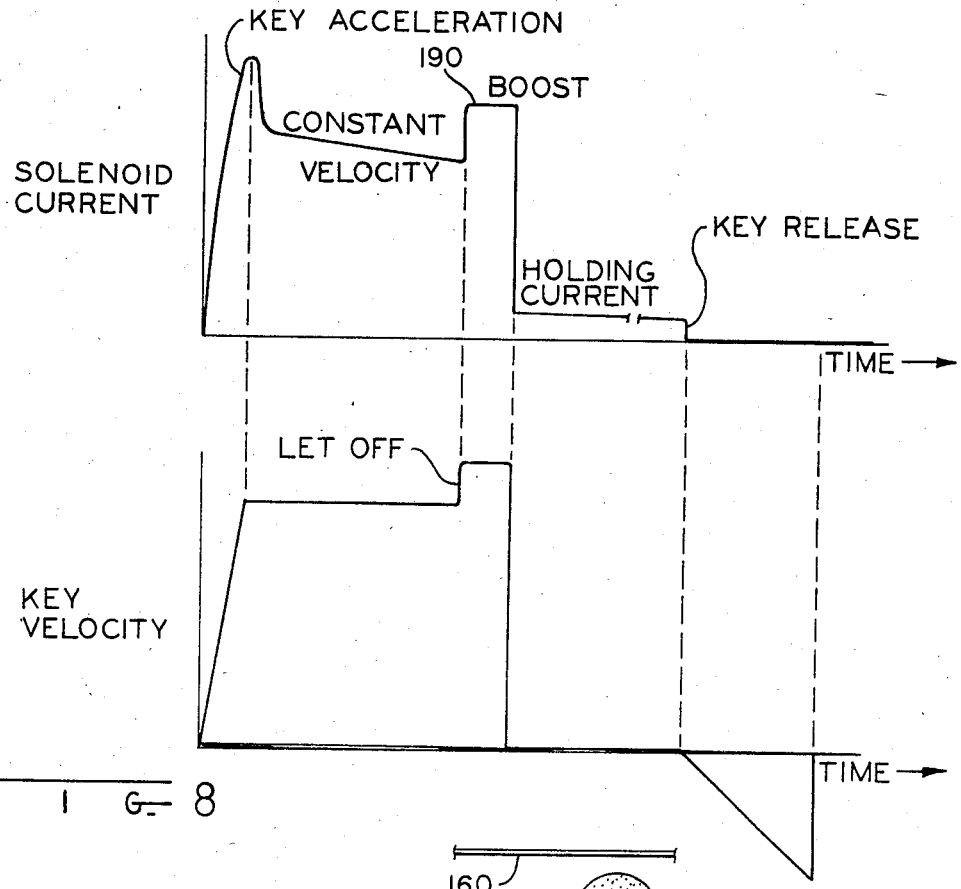
FIG. 8 is a diagrammatic view showing solenoid current and key velocity as a function of time during playback.

In operation, microprocessor 44 retrieves data from tape drive 50 calling for a particular drive value, transit delay, time of key release and key release transit time. The drive signal is processed by microprocessor 44, which may obtain calibration offsets or other data from EEPROM 60, and installs on the inputs 68 to digital to analog converter 66 a digital signal indicating the particular drive value for the initiation of the key depression. Key driver circuit 62 converts this digital signal to a current that energizes solenoid 70, thereby causing key 140 to be depressed with constant velocity. FIG. 8 illustrates typical solenoid current and key velocity to accomplish the key depression. As will be noted, the key accelerates rapidly to the steady state velocity, and the current through solenoid 70 is adjusted to ensure such constant velocity. As shutter 22 is raised by the movement of hammer 40 (FIG. 7), the upper edge 182 thereof breaks the light beam between source 28 and photocell 30 thereby transmitting a trigger signal on line 20 through interface 18 to microprocessor 44. Microprocessor 44 then installs a boost drive obtained from EEPROM 60 on the input 68 of MDAC 66, which calls for a higher key depression velocity. This occurs at about the time of let-off when hammer 146 is moving in free flight towards string 160. Drive circuit 62 converts the input value to a current through solenoid 72, which current is shown by portion 190 on the waveform of FIG. 8, thereby causing rapid acceleration of the key depression and movement of the action 38 so as to move jack 156 out of the return path of repetition roller 158.

If key 36 is to be held by solenoid 70, microprocessor 44 installs a holding current just sufficient to hold key 36 depressed and maintain the damper 192 out of contact with string 160 so the string continues to vibrate.

Figure 9:
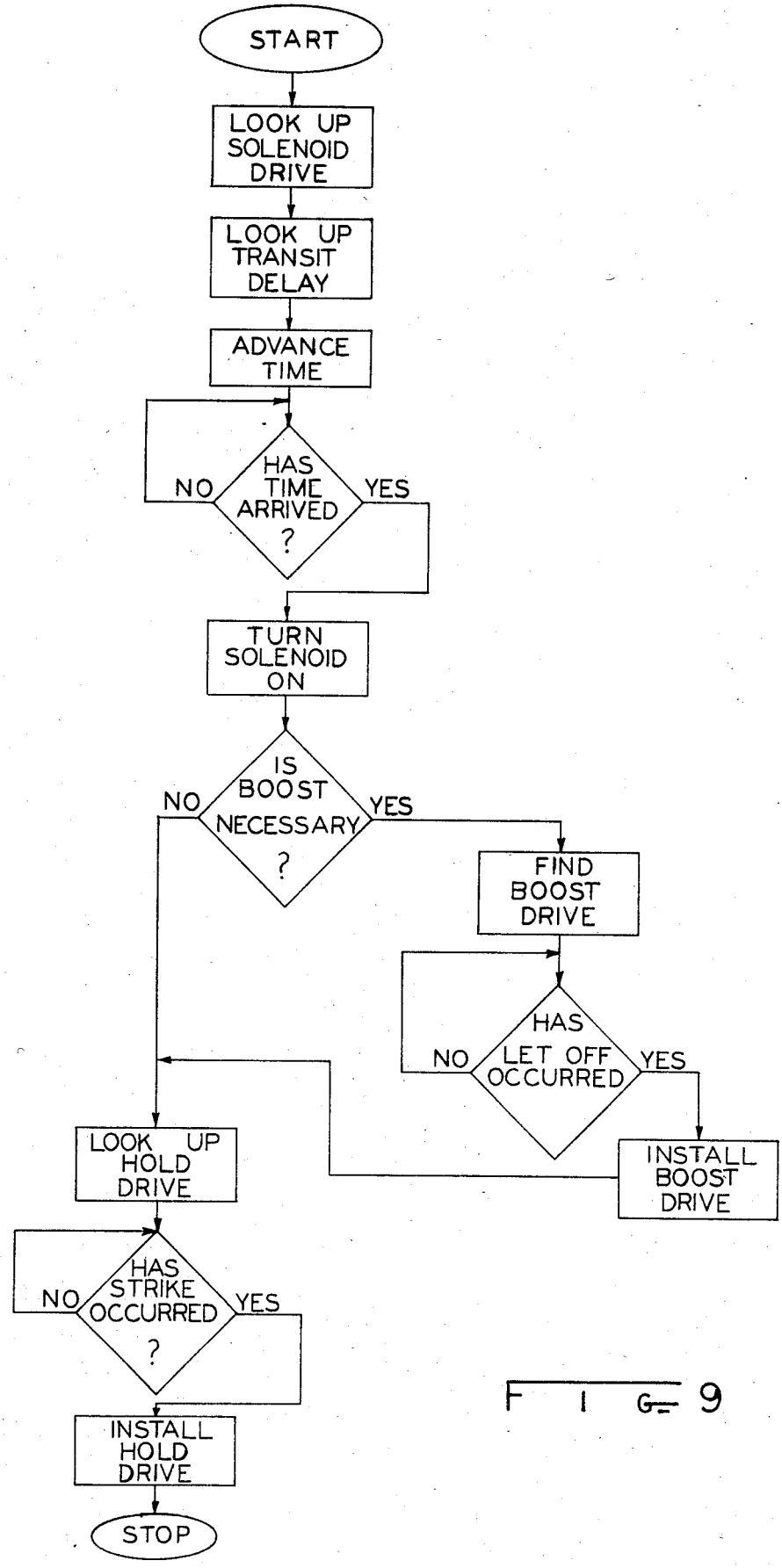
FIG. 9 is a flowchart showing the operation of the microprocessor of FIG. 1 and a method according to one form of the invention.

In the preferred embodiment of the invention, microprocessor 44 evaluates the data retrieved from tape 50, and installs a boost velocity drive value if the velocity drive value is below a predetermined level, which is selected depending on the characteristics of the particular piano in which the invention is installed. FIG. 9 illustrates the algorithm of microprocessor 44 for the preferred embodiment.

Although the invention has been described in application to a grand piano action, it could also be used with an upright piano in order to prevent double strikes.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A reproducing piano comprising:

a plurality of keys, piano action means actuated by said keys to move hammers into contact with respective strings when the pertaining keys are depressed, said hammers being positively engaged by said action means until let-off occurs after which the hammers travel in free flight toward the strings, and key actuation means including actuators in engagement with said keys for selectively moving said keys at a controlled velocity until let-off occurs and moving said keys at a second higher velocity after let-off occurs, whereby the action is accelerated after let-off to prevent double hammer strikes.

2. The piano of claim 1 wherein said actuation means includes: means associated with said action means for sensing when let-off occurs and transmitting a signal to a control circuit, said control circuit including means for passing a first current through said actuator just prior to let-off and for passing a second current higher than the first current through the actuator in response to the signal transmitted by said means for sensing.

3. The piano of claim 2 wherein said means for sensing comprises means for sensing a predetermined position of the hammer as it moves toward the string.

4. The piano of claim 3 wherein said means for sensing comprises an optical sensor means that senses by the movement of said hammer.

5. The piano of claim 1 wherein said key actuation means includes: microprocessor means under stored program control, and a actuator drive circuit means for energizing said actuator with a selected current corresponding to an actuator velocity drive signal at an input of the circuit means, said microprocessor means includes means for installing at the input of the circuit means a first velocity drive signal just prior to let-off and a second higher velocity drive signal subsequent to let-off.

6. The piano of claim 5 wherein said drive circuit includes digital-to-analog converter means connected to said input for converting a digital said drive signal to an analog velocity control signal.

7. A reproducing piano comprising:

a plurality of keys, piano action means actuated by said keys to move hammers into contact with respective strings when the pertaining keys are depressed, said hammers being positively engaged by said action means until let-off occurs after which the hammers travel in free flight toward the strings, an actuator means in engagement with each of said keys for actuating the respective key when the actuator means is energized, and a control means including a closed-loop current supply circuit means connected to said actuator means to energize said actuator means at a first controlled velocity during a first portion of the hammer actuating travel of the pertaining key and to energize said actuator means at a second velocity higher than the first velocity during a second portion of the hammer actuating travel of the key.

8. The piano of claim 7 wherein said control means includes sensor means for sensing when the hammer reaches a predetermined position and triggering said control means to energize said actuator means at the second velocity.

9. The piano of claim 7 wherein said control means includes a digital to analog converter means and a microprocessor means having an output connected to the input of said digital to analog converter means for selectively installing on said input digital values corresponding to the first and second velocities, and including a sensor means connected to an input of said microprocessor means for sensing when the hammer reaches a predetermined position and inputting a signal to said microprocessor means to initiate installing of the digital value corresponding to the second velocity.

10. The piano of claim 9 wherein said control means includes means for sensing when said hammer is traveling in free flight toward the string and initiating the supply circuit means to energize said actuator means at said second velocity.

11. A reproducing piano comprising:

a plurality of keys a piano action mechanism connected to each key including a hammer, a repetition roller connected to the hammer, and a jack positioned in engagement with the repetition roller and in the path of the repetition roller for moving the hammer toward a string when the pertaining key is depressed and moving out of the path of movement of the repetition roller after the hammer commences to travel in free flight toward the string, actuator means in engagement with said key for selectively moving said key in a direction to actuate said action to move said hammer against the string, and control means electrically connected to said actuator means for producing a current flow in said actuator means to move said key in said direction with a first controlled velocity and for producing a current flow through said actuator means to move said key in said direction with a second higher velocity after said hammer is in free flight toward said string thereby to cause said jack means to move out of the path of said repetition roller more quickly and prevent double hammer strikes of the string.

12. In a reproducing piano having a plurality of keys, a piano action connected to each key and in engagement with a pertaining hammer adapted to move the hammer to strike a respective string when the key is depressed, and a key actuator connected to each key, a method of depressing the key by actuator action in a manner to prevent double hammer strikes on the strings comprising:

passing a current through the actuator to depress the key at a first controlled velocity thereby causing the action to move the hammer in continuous positive engagement until the point of let-off at which time the hammer begins to travel in free flight toward the string, and subsequently passing a current through the actuator to depress the key at a second velocity higher than the first velocity beginning at about the point of let-off to accelerate a portion of the action out of a return path of the hammer as the hammer rebounds from the string thereby preventing double strikes of the hammer on the string caused by rebound from the action.

13. The method of claim 12 including the step of sensing when the hammer reaches a predetermined point in its travel toward the string and initiating the second key velocity at that time.

14. The method of claim 13 wherein the step of sensing includes optically sensing the hammer position.

15. In a reproducing piano having a plurality of keys, a piano action connected to each key and having a hammer propelled against a string by the action when the key is depressed, and a key actuator connected to the key, a method of controlling the energization of the actuator comprising:

passing a current through the actuator to depress the key at a first controlled velocity and cause the action to continuously, positively engage the hammer to move the hammer toward the string, and subsequently passing a current through the actuator to depress the key at a second velocity higher than the first velocity after the hammer commences to travel in free flight toward the string.

16. In a reproducing piano having a plurality of keys, a piano action connected to each key and having a hammer propelled against the string by the action when the key is depressed, and a key actuator connected to the key, a method of depressing a key during playback comprising:

retrieving a first actuator drive value from a non-volatile memory, converting the drive value to a first control current and energizing the actuator under the control of the first control current to cause the key to be depressed with a first velocity, determining if the first drive value is greater than a predetermined level, detecting when let-off in the action has occurred and installing a second actuator drive value corresponding to a higher current only if the first drive value is greater than the predetermined level, and converting the installed second value to a second control current and energizing the actuator under the control of the second current to cause the key to be depressed with a second velocity higher than the first velocity following let-off if the second drive value is installed.

* * * * *